US007477954B2

(12) United States Patent
LaNeve

(10) Patent No.: US 7,477,954 B2
(45) Date of Patent: Jan. 13, 2009

(54) WAGERING INTERFACE SYSTEM AND METHOD

(75) Inventor: Donald D LaNeve, Newark, DE (US)

(73) Assignee: Scientific Games International, Inc., Newark, DE (US)

( * ) Notice: Subject to any disclaimer, the term of this patent is extended or adjusted under 35 U.S.C. 154(b) by 337 days.

(21) Appl. No.: 10/034,069

(22) Filed: Dec. 27, 2001

(65) Prior Publication Data

US 2003/0125822 A1 Jul. 3, 2003

(51) Int. Cl.
*G06F 155/00* (2006.01)

(52) U.S. Cl. ..... 700/91

(58) Field of Classification Search ..... 463/1, 463/6, 16, 25, 29, 40–42; 700/91–93
See application file for complete search history.

(56) References Cited

U.S. PATENT DOCUMENTS

| | | | | |
|---|---|---|---|---|
| 3,697,698 | A | 10/1972 | Oswald et al. | 179/15 |
| 3,810,627 | A | 5/1974 | Levy | 273/138 |
| 3,909,002 | A | 9/1975 | Levy | 273/138 |
| 4,322,612 | A | 3/1982 | Lange | 235/419 |
| 4,339,798 | A | 7/1982 | Hedges et al. | 364/412 |
| 4,467,424 | A | 8/1984 | Hedges et al. | 364/412 |
| 4,592,546 | A | 6/1986 | Fascenda et al. | 273/1 |
| 4,652,998 | A | 3/1987 | Koza et al. | 364/412 |
| 4,669,730 | A | 6/1987 | Small | 273/138 |
| 4,694,490 | A | 9/1987 | Harvey et al. | 380/20 |
| 4,704,725 | A | 11/1987 | Harvey et al. | 380/9 |
| 4,706,121 | A | 11/1987 | Young | 358/142 |
| 4,745,468 | A | 5/1988 | Von Kohorn | 358/84 |
| 4,760,527 | A | 7/1988 | Sidley | 364/412 |
| 4,799,683 | A | 1/1989 | Bruner, Jr. | 273/138 |
| 4,815,741 | A | 3/1989 | Small | 273/138 |
| 4,876,592 | A | 10/1989 | Von Kohorn | 358/84 |
| 4,882,473 | A | 11/1989 | Bergeron et al. | 235/380 |
| 4,926,255 | A | 5/1990 | Von Kohorn | 358/84 |
| 4,951,039 | A | 8/1990 | Schwendeman et al. | 340/725 |
| 4,965,825 | A | 10/1990 | Harvey et al. | 380/9 |
| 5,038,022 | A | 8/1991 | Lucero | 235/380 |
| 5,057,915 | A | 10/1991 | Von Kohorn | 358/84 |
| 5,073,931 | A | 12/1991 | Audebert et al. | 380/23 |

(Continued)

FOREIGN PATENT DOCUMENTS

EP 0 387 046 A2 9/1990

(Continued)

OTHER PUBLICATIONS

Emerging Human-Computer Interface (HCI) Design Guides for Graphical User Interface (GUI), Battelle Pacific Northwest Labs, Oct. 1993.*

(Continued)

*Primary Examiner*—Ronald Laneau
*Assistant Examiner*—Tramar Harper
(74) *Attorney, Agent, or Firm*—Dority & Manning, P.A.

(57) ABSTRACT

In a method and system for providing racing information to a user, a request for program information for races within a multiple race wager group is received. Respective program information specific to each race within the multiple race wager group are displayed together in a single graphical user interface screen.

32 Claims, 9 Drawing Sheets

U.S. PATENT DOCUMENTS

| | | | | |
|---|---|---|---|---|
| 5,083,271 | A | 1/1992 | Thacher et al. | 364/411 |
| 5,083,800 | A | 1/1992 | Lockton | 273/439 |
| 5,108,115 | A | 4/1992 | Berman et al. | 273/439 |
| 5,109,414 | A | 4/1992 | Harvey et al. | 380/9 |
| 5,128,752 | A | 7/1992 | Von Kohorn | 358/84 |
| 5,212,636 | A | 5/1993 | Nakazawa | 364/412 |
| 5,227,874 | A | 7/1993 | Von Kohorn | 358/84 |
| 5,233,654 | A | 8/1993 | Harvey et al. | 380/20 |
| 5,249,044 | A | 9/1993 | Von Kohorn | 358/86 |
| 5,259,613 | A | 11/1993 | Marnell, II | 273/138 |
| 5,283,734 | A | 2/1994 | Von Kohorn | 364/412 |
| 5,340,119 | A | 8/1994 | Goldfarb | 273/439 |
| 5,408,417 | A | 4/1995 | Wilder | 364/479 |
| 5,411,258 | A | 5/1995 | Wilson et al. | 273/86 |
| 5,415,416 | A | 5/1995 | Scagnelli et al. | 273/439 |
| 5,462,275 | A | 10/1995 | Lowe et al. | 273/94 |
| 5,564,977 | A | 10/1996 | Algie | 463/25 |
| 5,573,244 | A | 11/1996 | Mindes | 463/26 |
| 5,594,509 | A | 1/1997 | Florin et al. | 348/731 |
| 5,629,508 | A | 5/1997 | Findley, Jr. et al. | 235/38 |
| 5,647,795 | A | 7/1997 | Stanton | 463/1 |
| 5,674,128 | A | 10/1997 | Holch et al. | 463/42 |
| 5,722,890 | A | 3/1998 | Libby et al. | 463/17 |
| 5,749,785 | A | 5/1998 | Rossides | 463/25 |
| 5,759,101 | A | 6/1998 | Von Kohorn | 463/40 |
| 5,816,919 | A | 10/1998 | Scagnelli et al. | 463/25 |
| 5,830,068 | A | 11/1998 | Brenner et al. | 463/42 |
| 5,842,921 | A | 12/1998 | Mindes et al. | 463/16 |
| 5,904,619 | A | 5/1999 | Scagnelli et al. | 463/17 |
| 5,910,047 | A | 6/1999 | Scagnelli et al. | 463/17 |
| 5,921,865 | A | 7/1999 | Scagnelli et al. | 463/17 |
| 5,991,756 | A | 11/1999 | Wu | |
| 6,004,211 | A | 12/1999 | Brenner et al. | 463/40 |
| 6,089,981 | A | 7/2000 | Brenner et al. | |
| 6,099,409 | A * | 8/2000 | Brenner et al. | 463/40 |
| 6,260,019 | B1 | 7/2001 | Courts | |
| 6,266,659 | B1 | 7/2001 | Nadkarni | |
| 6,358,150 | B1 * | 3/2002 | Mir et al. | 463/28 |
| 6,539,545 | B1 * | 3/2003 | Dureau et al. | 725/48 |
| 6,554,708 | B1 | 4/2003 | Brenner et al. | |
| 6,554,709 | B1 | 4/2003 | Brenner et al. | |
| 6,652,378 | B2 * | 11/2003 | Cannon et al. | 463/20 |
| 6,712,701 | B1 | 3/2004 | Boylan, III et al. | |
| 6,722,980 | B2 * | 4/2004 | Stronach | 463/25 |
| 2001/0034268 | A1 | 10/2001 | Thomas et al. | |
| 2001/0039209 | A1 | 11/2001 | DeWeese et al. | |
| 2001/0047291 | A1 | 11/2001 | Garahi et al. | |
| 2001/0051540 | A1 | 12/2001 | Hindman et al. | |
| 2002/0032677 | A1 | 3/2002 | Morgenthaler et al. | |
| 2002/0049975 | A1 | 4/2002 | Thomas et al. | |
| 2002/0068633 | A1 * | 6/2002 | Schlaifer | 463/43 |
| 2002/0077712 | A1 * | 6/2002 | Safaei et al. | 700/93 |
| 2002/0142816 | A1 * | 10/2002 | Stronach | 463/6 |
| 2003/0144054 | A1 * | 7/2003 | DeWeese et al. | 463/30 |
| 2003/0157976 | A1 * | 8/2003 | Simon et al. | 463/1 |
| 2003/0195038 | A1 * | 10/2003 | DeWeese et al. | 463/30 |
| 2005/0208995 | A1 * | 9/2005 | Marshall et al. | 463/25 |

FOREIGN PATENT DOCUMENTS

| | | | |
|---|---|---|---|
| EP | 0 450 520 | A2 | 10/1991 |
| EP | 0 620 688 | A2 | 10/1994 |
| EP | 0 624 039 | A2 | 11/1994 |
| GB | 2138602 | A | 10/1984 |
| GB | 2 229 565 | A | 9/1990 |
| GB | 23000535 | A | 11/1996 |
| JP | 401269162 | A | 10/1889 |
| JP | 401025659 | A | 1/1989 |
| JP | 401269157 | A | 10/1989 |
| JP | 402110660 | A | 4/1990 |
| JP | 402231671 | A | 9/1990 |
| JP | H06-325062 | | 11/1994 |

OTHER PUBLICATIONS

The Motley Fool, Fool.com, stock portfolio web page © 1998-2003 BigCharts.com Inc. (2 pages) [http://portfolios.fool.com/custom/fool-com/portfolio].

Miller, Matthew D., "A Scenario for the Deployment of Interactive Multimedia Cable Television Systems in the United States in the 1990's," Proceedings of the IEEE, vol. 82, No. 4, Apr. 1994.

Chang, Yee-Hsiang et al., "An Open-Systems Approach to Video on Demand," IEEE Communications Magazine, May 1994.

Peddicord, Ross, "New on TV: You Bet Your Horse," *Baltimore Sun*, Dec. 15, 1994.

Perrone, Vinnie, "The Home Betting Channel—Maryland 1" to Test Interactive TV Wagers," *Washington Post*, Dec. 15, 1994.

Burgess, John, "And We're Off to the Races!" *Washington Post*, Jan. 16, 1995.

Heistand, Michael, "Sports on TV-13 Home Wagering is on the Way," *USA Today*, Dec. 7, 1994.

Chartrand, Sabra, Patents "A Florida Inventor Puts His Money on a Gambling Network for Interactive Television," *New York Times*, Feb. 28, 1994.

Finley, Scott, "Online Betting in the Internet Age," *The HorsePlayer Magazine*, Mar./Apr. 2001 Issue, pp. 8-10, 12, 14 and 17.

Finley, Bill, "Room for Two TV Vehicles on the Information Superhighway (TVG, TRN, Speeding to Transport More Viewers to More Tracks)," *The HorsePlayer Magazine*, Mar./Apr. 2001 Issue, pp. 18-20, 22, 24 and 26.

* cited by examiner

| | 1 | 2 | 3 | 4 | 5 | 6 | 7 | 8 |
|---|---|---|---|---|---|---|---|---|
| 1 | X | 37.80 | 12.50 | 10.50 | 135.21 | 40.00 | 71.25 | 301.05 |
| 2 | 33.51 | X | 38.14 | 29.13 | 124.01 | 39.78 | 54.23 | 298.20 |
| 3 | 10.48 | 36.27 | X | 25.67 | 99.00 | 54.17 | 62.49 | 197.30 |
| 4 | 11.78 | 27.50 | 22.13 | X | 115.97 | 72.80 | 47.58 | 119.30 |
| 5 | 141.24 | 115.21 | 98.34 | 111.04 | X | 195.07 | 84.48 | 189.46 |
| 6 | 39.52 | 43.05 | 59.34 | 66.09 | 181.00 | X | 65.02 | 200.00 |
| 7 | 58.17 | 52.16 | 71.36 | 63.24 | 97.38 | 71.38 | X | 168.41 |
| 8 | 240.01 | 351.21 | 175.47 | 201.37 | 174.37 | 201.38 | 135.48 | X |

WAGERING INTERFACE SYSTEM AND METHOD

FIELD OF THE INVENTION

This invention relates to wagering systems and methods, and more particularly to methods and systems for presenting program and probable payout wagering information.

BACKGROUND OF THE INVENTION

FIG. 1 illustrates a prior art graphical displays 10 for providing probable payout information to a wagerer. Specifically, the display 10 of FIG. 1 displays probable payouts for an "exotic" wager that includes a selection of two entrants from a race, such as a horse race. More specifically, FIG. 1 shows probable payouts for an exacta wager for a particular race. As indicated by columns 12 and by rows 14, the race associated with the display 10 includes eight entrants ("1" through "8"). The display 10 shows the probable payouts for every possible exacta combination of the identified entrants. For example, an exacta wager including horse "4" finishing second (indicated by column 12*a*) and horse "8" finishing first (indicated by row 14*a*) has a probable payout of $201.37 on a standard $2 wager. Conversely, an exacta wager including horse "8" finishing second (indicated by column 12*b*) and horse "4" finishing first (indicated by row 14*b*) has a probable payout of $119.46 on a standard $2 wager.

Similar displays correspond to other exotic two horse wagers, including quiniela wagers and daily double wagers. For quiniela wagers, the probable payout listed for a column X and row Y is the same as the probable payout listed for a column Y and row X because the order of the first and second place finishers is not specified for a quiniela wager. For daily double wagers, the entrants of a first race are typically listed in rows 14 and the entrants of the second race included in the daily double wager are typically listed in columns 12. Of course, each race need not have the same number of entrants, and the grid of displays 10 is configured accordingly.

The prior art display 10 may be displayed on an electronic display board at a track or at an off-track betting (OTB) facility, or more recently, as a Web page provided to a wagerer's browser-enabled computer through the Internet. The display 10 is typically updated periodically as odds and pools change to indicate changes in probable payouts for the exotic wager.

While the display 10 described above provides comprehensive probable payout information to a wagerer, the display 10 can prove overwhelming. The display provides all probable payout information at once, providing a congested display that often provides extraneous information on combinations that are of no interest to a particular wagerer.

There remains a need, therefore, for an improved method and system of presenting probable payout information for exotic wagers. Still further, there remains a need for an interactive method and system of presenting probable payout information as dictated by a wagerer's particular wagering interests.

As briefly explained above in connection with daily double wagers, several exotic wagers require a selection of entrants from two or more races. Examples of these exotic wagers include daily double wagers, pick three wagers, pick six wagers, pick nine wagers, win four wagers and place pick nine wagers. Particularly with Internet based wagering systems, a separate Web page screen is utilized to show entrant information for each race. For example, a first Web page provided to a wagerer's computer displays information relevant to a first race, e.g., entrant number, morning line odds, and horse, jockey and trainer name for each entrant. A second Web page must be requested by the user and displayed to the user in order to view similar information for a second race, and so on for each race at the track. This method of providing racing information to the wagerer makes examining this information very cumbersome and makes placing multiple race, exotic wagers overly complex. The wagerer typically types his or her wager into a graphical interface, but the wagerer must recall the aforementioned information for each race from memory during the decision making process or continually navigate different interface screens to access program information for different races. This proves increasingly more difficult as wager complexity increases, i.e., as the number of races associated with a wager increases. Therefore, there remains a need for an improved method and system of providing racing information to a wagerer for multiple race exotic wagers.

SUMMARY OF THE INVENTION

In a method and system for providing racing information to a user, a request for program information for races within a multiple race wager group is received. Respective program information specific to each race within the multiple race wager group are displayed together in a single graphical user interface screen.

In a method and system for providing probable payout information to a user for an exotic wager where the exotic wager type requires either a selection of two entrants from a single race or an entrant from each of two races, a table is displayed in a graphical user interface screen. The table includes first probable payout information for the exotic wager type. The first probable payout information indicates (1) a respective probable payout for a selection of a first entrant from a first race and a selection of one or more other entrants from the first race or (2) a respective probable payout for a selection of the first entrant from the first race and a selection of one or more entrants from a second race. In response to a request by the user, a reconfigured table is displayed in the graphical user interface screen. The reconfigured table includes second probable payout information for the exotic wager type. The second probable payout information indicates (1) a respective probable payout for a selection of a second entrant from the first race and a selection of one or more other entrants from the first race, or (2) a respective probable payout for a selection of the second entrant from the first race and a selection of one or more entrants from the second race.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention as well as other information pertinent to the disclosure, in which.

DETAILED DESCRIPTION OF THE INVENTION

The Internet is a worldwide system of computer networks—a network of networks in which a user at one computer can obtain information from any other computer and communicate with users of other computers. The most widely used part of the Internet is the World Wide Web (often-abbreviated "WWW" or called "the Web"). One of the most outstanding features of the Web is its use of hypertext, which is a method of cross-referencing. In most Web sites, certain words or phrases appear in text of a different color than the surrounding text. This text is often also underlined. Sometimes, there are buttons, images or portions of images that are "clickable." Using the Web provides access to millions of pages of information. Web "surfing" is done with a Web browser; the most popular of which presently are Netscape Navigator and Microsoft Internet Explorer. The appearance of a particular website may vary slightly depending on the particular browser used. Recent versions of browsers have "plug-ins," which provide animation, virtual reality, sound and music.

Figure 1:
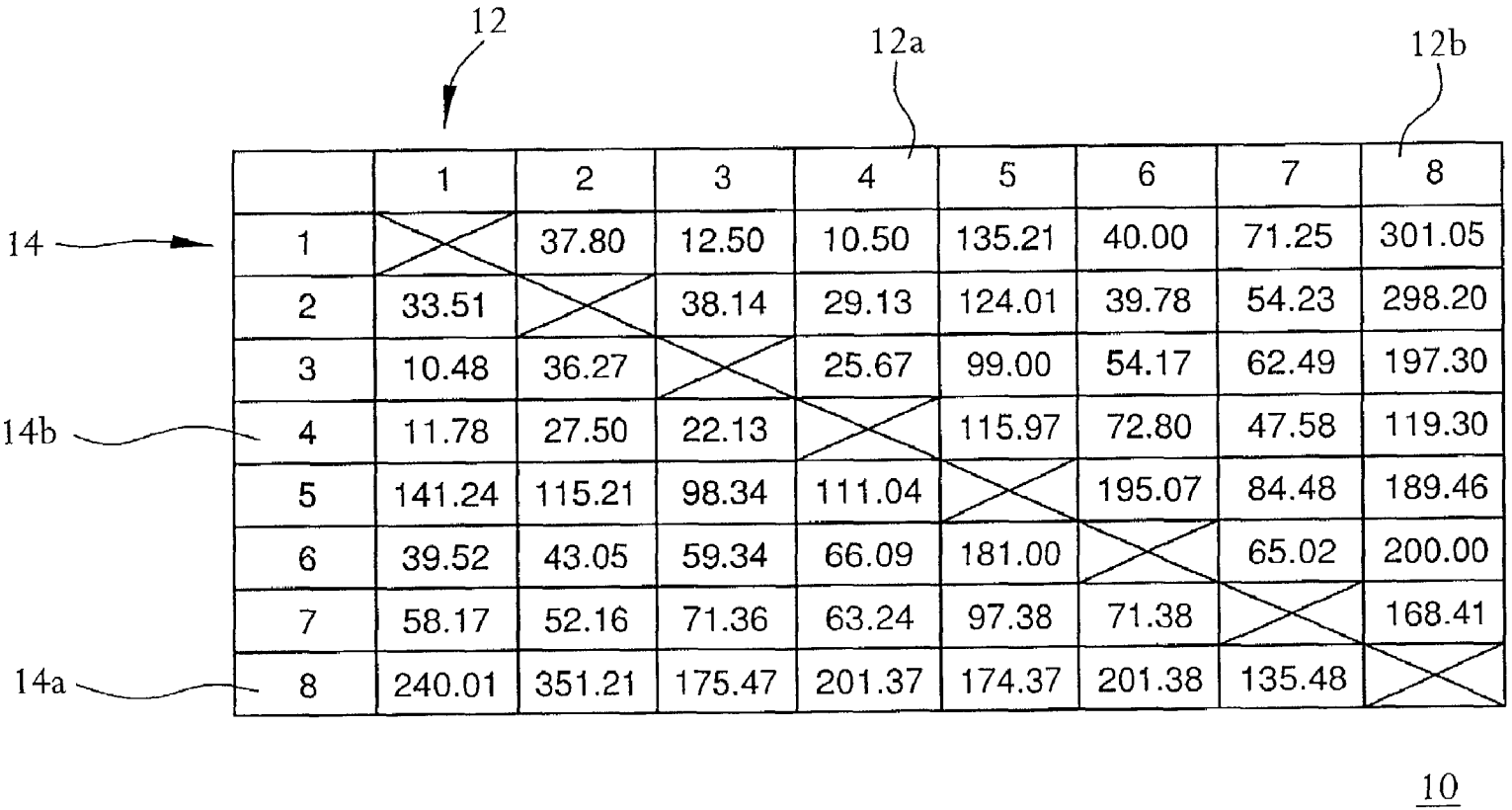
FIG. 1 (PRIOR ART)
FIG. 1 illustrates a prior art display showing probable payouts for an exotic wager type requiring a selection of two entrants.
Figure 2:
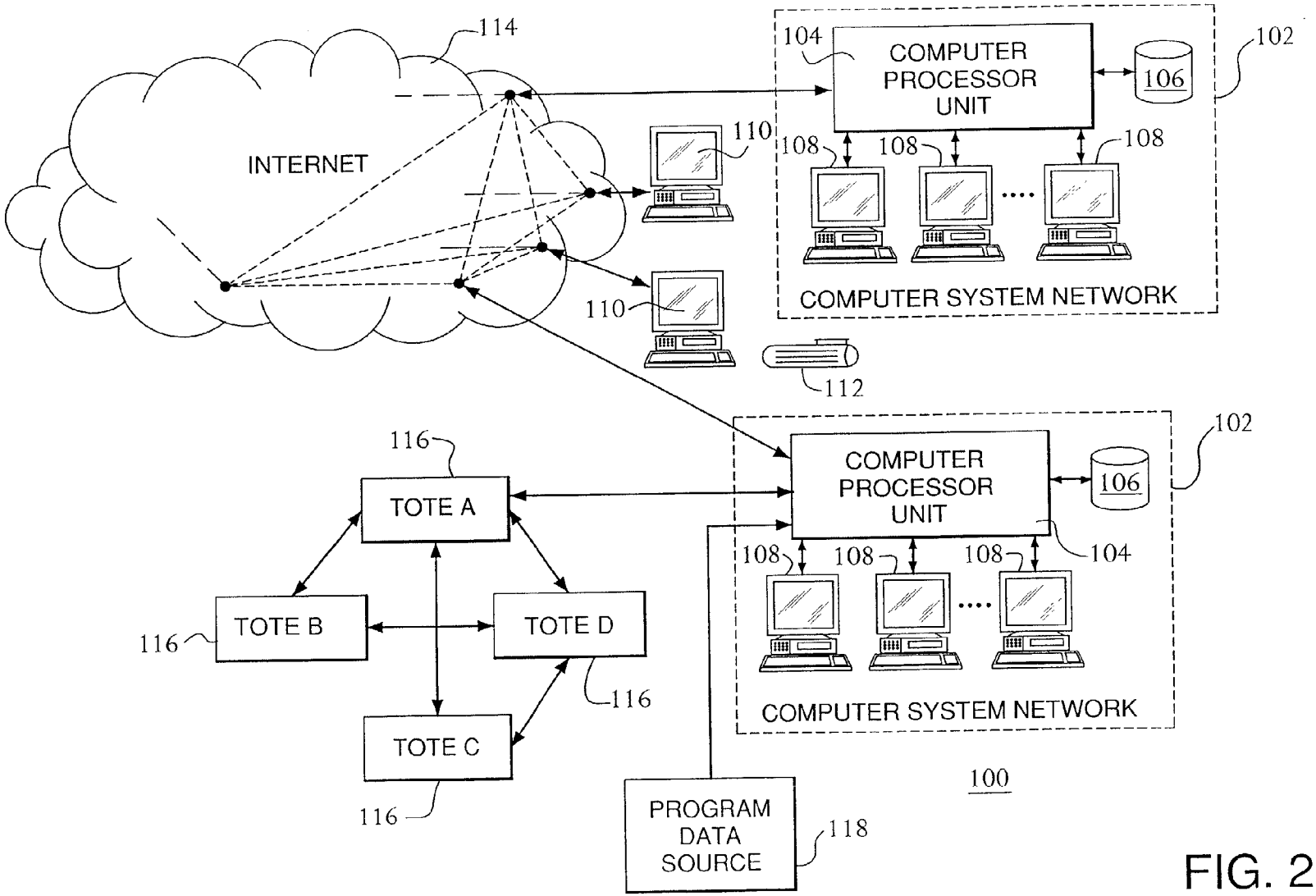
FIG. 2 is a stylized overview of a system of interconnected computer networks connected to a totalisator network.

FIG. 2 shows a system 100 of interconnected computer system networks 102. Each computer system network 102 contains a corresponding local computer processor unit 104, which is coupled to a corresponding local data storage unit 106, and local network user terminals 108. A computer system network 102 may be a local area network (LAN) or part of a wide area network (WAN), for example. The local computer processor units 104 are selectively coupled to a plurality of user devices 110 through Internet 114 described above. Each of the plurality of user devices 10 and local user terminals 108 (collectively, user terminals) may have various devices connected to their local computer systems, such as scanners, barcode readers, printers, finger print scanners, mouse devices, and other interface devices 112.

A user device 110, programmed with a Web browser or other software, locates and selects (such as by clicking with a mouse) a particular Web page, the content of which is located on the local data storage unit 106 of a computer system network 102, in order to access the content of the Web page. The Web page may contain links to other computer systems and other Web pages.

The user device 110 may be a microprocessor-based computer terminal, a pager that can communicate through the Internet using the Internet Protocol (IP), a Kiosk with Internet access, a connected personal digital assistant or PDA (e.g., a PALM device manufactured by Palm, Inc.) or other device capable of interactive network communications, such as an electronic personal planner. User device 110 may also be a wireless device, such as a hand-held unit (e.g., cellular telephone) that connects to and communicates through the Internet using the wireless access protocol (WAP).

The system 100 also includes an interconnected system of totalisators 116 (illustrated by way of example as four totalisators Tote A through Tote D) and a data source 118 connected to a computer processor unit 104. Specifically, a totalisator 116 indicated as "Tote A" is shown connected to the computer processor unit 104. A totalisator is a computer system that generates wagering odds based on wagers placed on racing events at various tracks. Typically, each racetrack has an installed totalisator for calculating the wagering odds, pools and probable payout information at that track. The totalisators are capable of communicating data to each other using the Intertote Track System Protocol (ITSP), and they maintain wagering accounts for wagerers. The communications between totalisators allow totalisators to share pools, thereby allowing racing fans that interact with one totalisator and/or maintain an account with that totalisator to view odds and place wagers on races at other tracks. The totalisators generally recompile data pertaining to the pools at fixed periods, such as every sixty seconds, and recalculate odds and probable payouts for specific wagers.

Tote A, shown connected to the computer processor unit 104 of FIG. 2, provides odds, pool and probable payout information to the computer processor unit 104. The totalisator also provides the current race number and status, minutes to post information, winning results and prices, overweights, and scratch information. The computer processor unit 104 stores this data in data storage unit 106. This information is provided to the computer processor unit through a serial data link and is updated at periodic intervals, i.e., updated odds, pools, probable payout, overweight and scratch information are transmitted from Tote A to computer processor unit 104 at periodic intervals for storage in database 106.

Similarly, one or more program data source 118 provides program information to computer processor unit 104, such as horse jockey and trainer names, entrant number, medications (e.g., lazix or bute), claim value, carried weight and morning line odds. Other relevant racing information may also be provided by a data source 118, such as weather information and handicapping information. As mentioned, updated information is also provided by a totalisator 116 to computer processor unit 104 at periodic intervals to reflect scratches, entrant changes, and other changes in the program information. Program information and other racing data are available from data sources operated by companies such as Equibase Company LLC of Lexington, Ky.

Each wagerer maintains an account with a totalisator that is associated with a racetrack, e.g., Fairgrounds, Thistledown, Golden Gate Fields, etc. A wagerer preferably has a single account that services account wagering for telephone wagers, live wagers and on-line account wagering.

Figure 3:
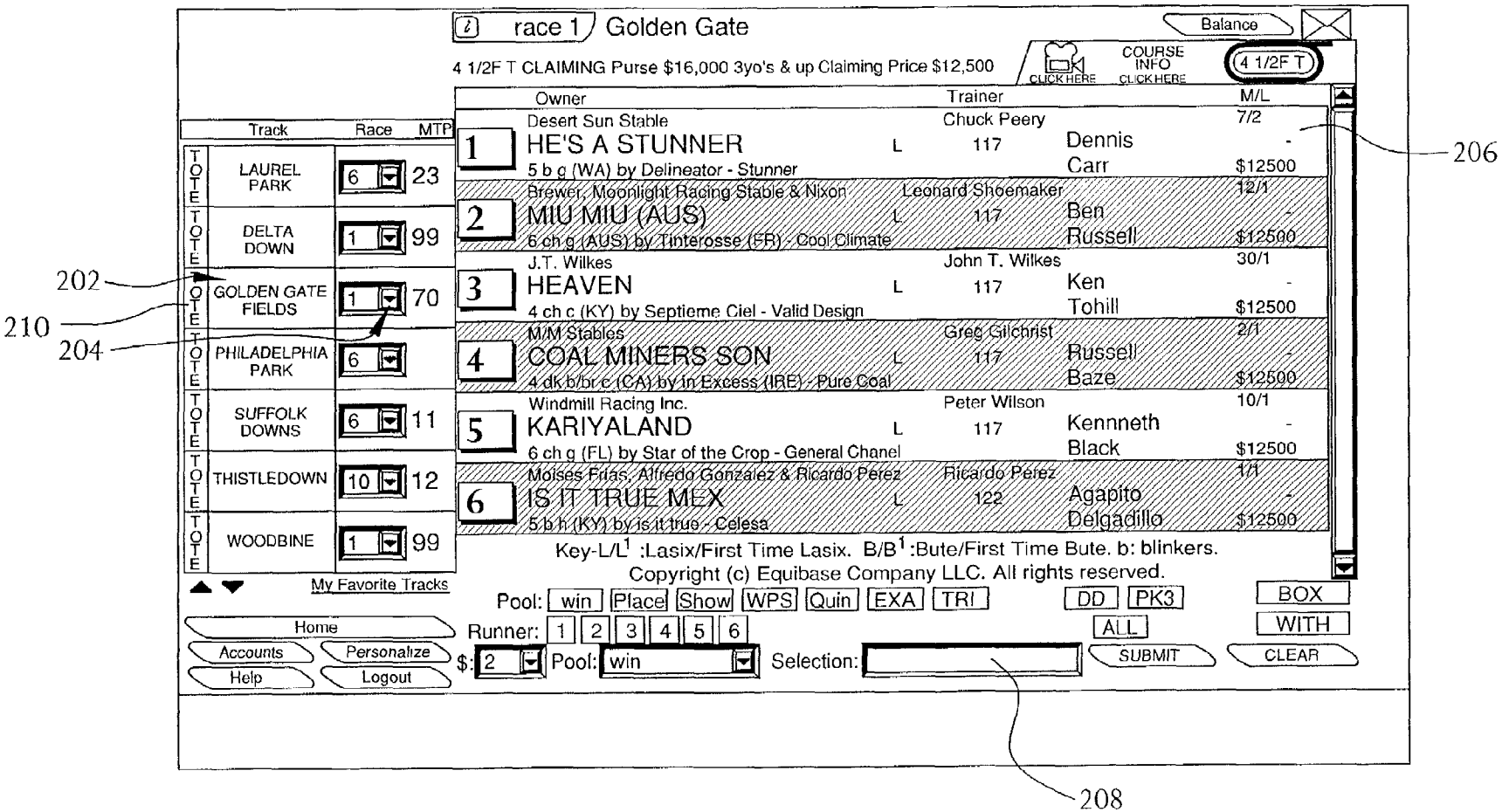
FIGS. 3 and 3A illustrate an exemplary graphical user wagering interface showing program information for a horse race.
Figure 3A:
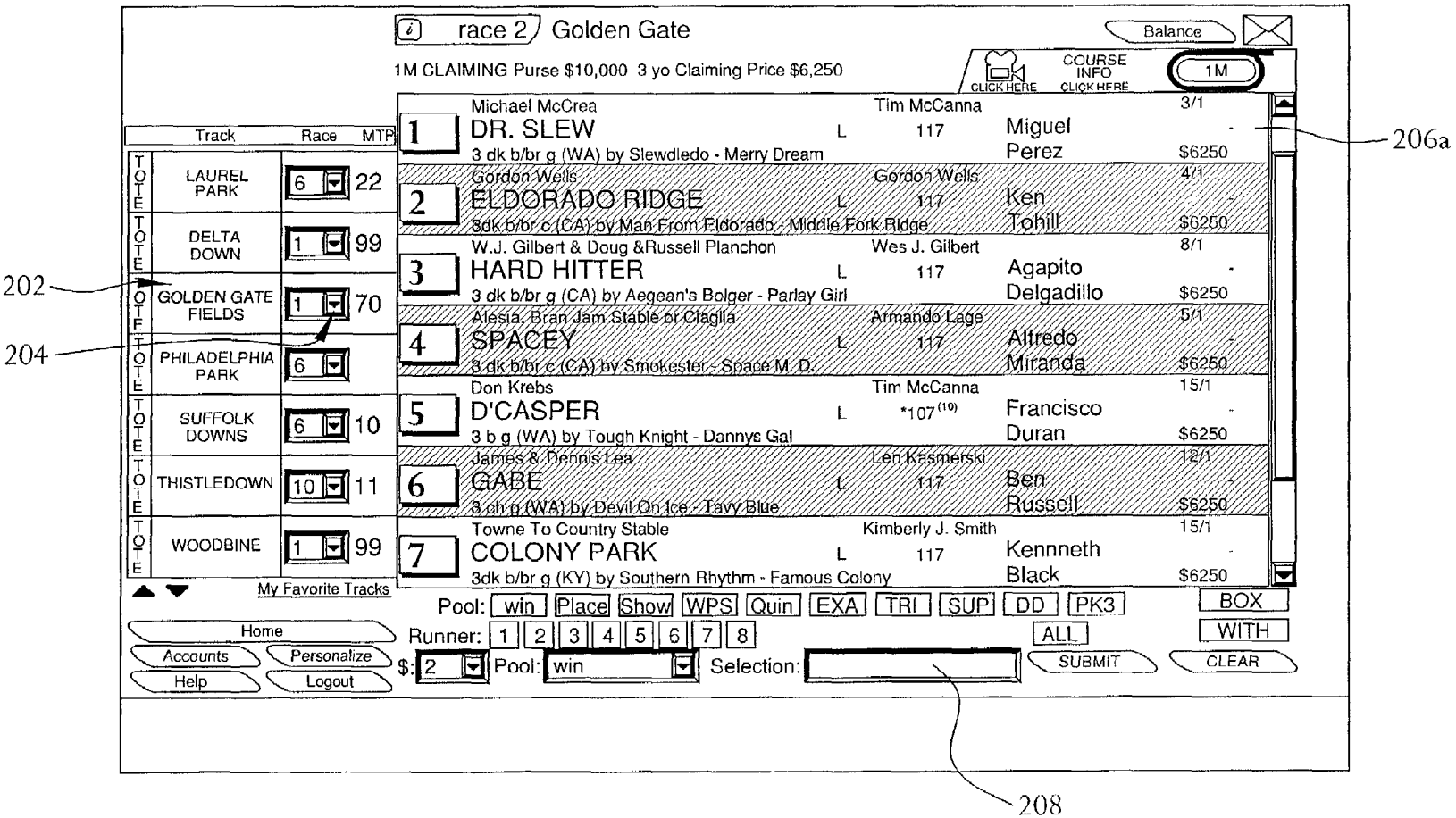

Referring to FIG. 3, a graphical user interface showing program information for "Race 1" at Golden Gate Fields is illustrated. The graphical user interface may be a Web page displayed by a browser enabled user terminal 108, 110. A computer processor unit 104 provides the interface from a data storage unit 106 through the Internet 114 to a user terminal, 108 or 110. Racing information, such a program information as shown at 206, for races at a plurality of different tracks can be requested from the computer processor unit 104 through the graphical user interface as shown in FIG. 3. The wagerer need only select, such as by "clicking" on a selectable region of the graphical user interface, the name of a desired race rack, as shown for example at 202, and a desired race, as shown by, for example, pull down menu 204, and a graphical user interface including the requested racing information is provided to the user terminal 108, 110 for display to the user. Similar to FIG. 3, FIG. 3A shows a graphical user interface displaying program information at 206*a* for the second race—"Race 2"—at Golden Gate Fields. As explained, program information for Race 2 at Golden Gate Fields is displayed by selecting the Golden Gate Fields icon at 202 and "2" from pull down menu 204.

Specific wagers can be selected by a user by "clicking" on selectable buttons on the graphical interface, such a "Win," "Place," "Show" etc. along with the desired runner number, e.g., "1," "2", etc., and wager amount, e.g., "$2," "$4", etc. The wager can also be manually entered in text box 208 using a keyboard connected to a user terminal. A few specific features of an exemplary graphical user wagering interface are further described hereafter in connection with FIGS. 4-7.

An exemplary method and system for providing probable payout information to a user for exotic wagers is described in connection with FIGS. 3, 4, 4A and 6. FIG. 3 indicates that various exotic wagers are available in connection with Race 1 at Golden Gate Fields, i.e., win, place, show, win-place-show (WPS), quiniela (Quin), exacta (EXA), trifecta (TRI), daily double (DD), pick three (PK3), and various boxed combinations. Some exotic wagers require a selection of two entrants from a single race (e.g., exacta and quiniela wagers) and some require the selection of an entrant from each of two races (e.g., a daily double wager). By selecting the "Tote" option 210 associated with the Golden Gate Fields track, probable payout information for these exotic wagers for races at Golden Gate Fields is provided to the user, as shown in FIGS. 4 and 4A.

Figure 4:
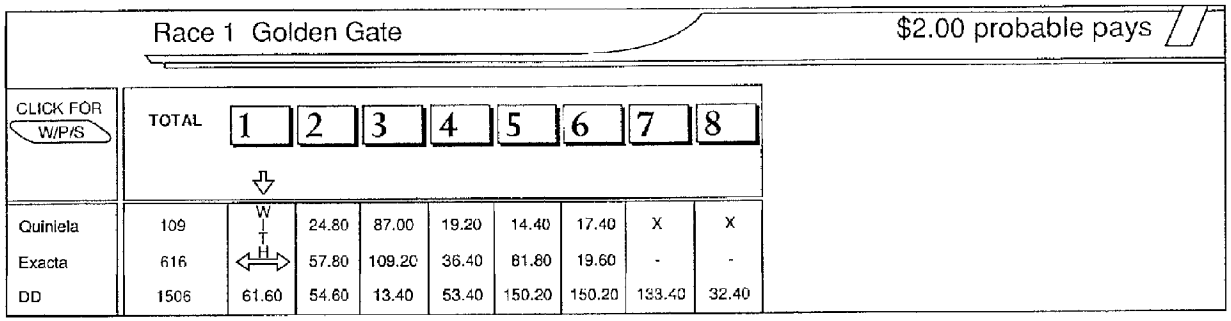
FIGS. 4 and 4A illustrate an exemplary graphical user interface for providing probable payout information for exotic wagers.

FIG. 4 illustrates an exemplary graphical user interface for providing probable payout information for exotic wagers such as quiniela, exacta and daily double wagers. As indicated in FIG. 3, Race 1 at Golden Gate Fields includes six entrants. Race 2, which is the second half of a daily double wager including Race 1, has eight entrants. Program information for the eighth entrant for Race 2 is available through the graphical interface of FIG. 3 by manipulating the scroll bar displayed in FIG. 3A. An entrant numbers "1" through "8" are displayed in a table of the graphical user interface shown in FIG. 4. The graphical user interface defaults to display exotic wagers including the first entrant from a first race, as indicated by the arrow displayed below "1". Probable payout information for exotic wager including this first entrant are displayed as described hereafter.

Figure 4A:
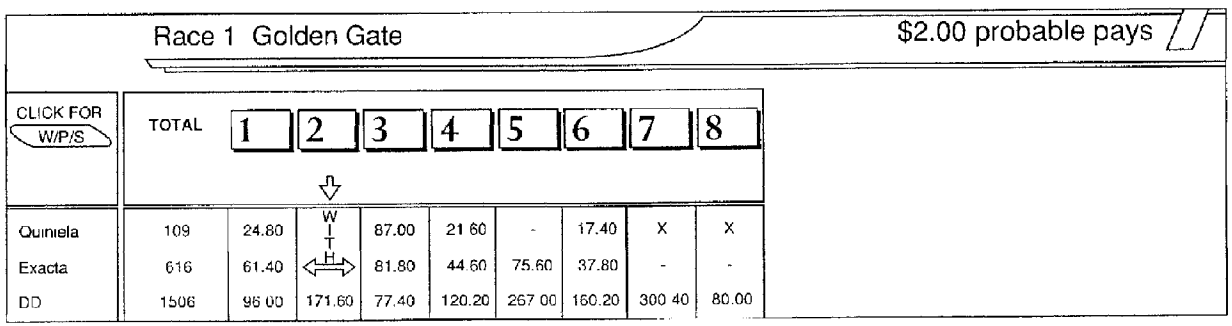

The first row of the table of FIG. 4A displays probable payouts for quiniela wagers in Race 1. For example, a quiniela wager including the first entrant "with" the second entrant "2" of Race 1 has a probable payout of "$24.80" on a $2.00. A quiniela wager including the first entrant "1" of Race 1 "with" the third entrant "3" of Race 1 has a probable payout of "$87.00." A quiniela wager including the first entrant "1" "with" the fourth entrant "4" has a probable payout of "$19.20," and so forth across the table through entrant number "6." No probable payouts are listed for quinela wagers under entrant numbers "7" and "8" because Race 1 only includes six entrants. Entrants "7" and "8," however, are pertinent to a daily double wager as described below.

The probable payout information is provided from Tote A to computer processor unit 104 and then stored in a data storage unit 106. The probable payout information is then provided by computer processor unit 104 from data storage unit 106 to a user terminal 108 or 110 for display in the graphical user interface of FIG. 4. As mentioned above, Tote A provides updated probable payout and odds information to the computer processor unit 104 at periodic intervals, as well as other updated information, such as scratches and overweights. The updated probable payout information and other updated information are provided by the computer processor unit 104 to the user terminal 108 or 110 in order to update the table displayed in the graphical user interface as shown in FIG. 4 to indicate updated probable payouts and scratches. This may be accomplished through an automatic and periodic "refresh" if the graphical user interface is a Web page.

The entrant numbers "1" through "6" are preferably selectable, such as by clicking on them using a pointer device, such as a mouse connected to a user terminal, that allows the user to interact with the graphical user interface. By selecting entrant "2," a reconfigured table is shown in the graphical user interface, as illustrated by FIG. 4A. By selecting entrant "2," a request may be sent to the computer processor unit 104 for a new Web page. More preferably, however, the request for probable payout information for exotic wagers including entrant "2" is processed by a program applet transmitted to the user terminal from computer processor unit 104 along with the graphical user interface of FIG. 3 or when the Tote option 210 is selected by the user. In this embodiment, computer processor unit 104 provides probable payout information for all of the possible entrant combinations (and updated probable payout information at periodic intervals) for the available exotic wagers. Probable payout information for entrant "1" is initially, but not necessarily, displayed as shown in FIG. 4. In response to the selection of "2" on the graphical user interface of FIG. 4, the applet provided by the computer processor unit 104 instructs the user terminal 108 or 110 to display an appropriately reconfigured table using the probable payout information provided by the computer processor unit 104. As shown in FIG. 4A, the reconfigured table indicates that a quiniela wager including entrant "2" "with" entrant "1" has a probable payout of "$24.80."

Note, this amount is the same as the probable payout displayed in the table of FIG. 4 for a selection of entrant "1" and entrant "2" because a quiniela wager does not require a specific finishing order. A quiniela wager including a selection of entrant "2" "with" entrant "4" has a probable payout of "$21.60," and so forth. No probable payout is listed for entrant "5," indicating that no wagers have yet to be placed on the quiniela combination of the second entrant with the fifth entrant.

As shown in FIGS. 4 and 4A, probable payout information for one or several different exotic wagers can be displayed simultaneously in a very space efficient table in a graphical user interface. Probable payouts for the exacta wager are discerned from the table in the same manner as described in connection with the quiniela wagers. For example, an exacta wager, which does require a specific finishing order, including a first place finish for entrant "1" with a second place finish for entrant "2" has a probable payout of "$57.80" and an exacta wager including a first place finish for entrant "2" with a second place finish for entrant "1" has a probable payout of "$61.40."

Daily double (DD) probable payouts are also displayed in the tables shown in FIGS. 4 and 4A. Referring first to FIG. 4, entrant numbers "1" through "6" displayed in the table represent entrants "1" through "6" for both the first race at Golden Gate Fields and the second race at Golden Gate Fields. Being that Race 1 only includes six entrants and Race 2 includes eight entrants, numbers "7" and "8" represent entrants seven and eight from Race 2, respectively. For example, a daily double wager including the first entrant from Race 1 and the first entrant from Race 2—the second leg of the daily double wager—has a probable payout of "$61.60." A daily double wager including the first entrant from Race 1 and the fourth entrant from Race 2 has a probable payout of "$53.40." A daily double wager including the first entrant from Race 1 and the eighth entrant from Race 2 has a probable payout of "$32.40." Referring to FIG. 4A, a daily double wager including the second entrant from Race 1 and the first entrant from Race 2 has a probable payout of "$96.00." A daily double wager including the second entrant from Race 1 and the second entrant from Race 2 has a probable payout of $171.60," and so forth.

Entrant numbers "7" and "8" from FIGS. 4 and 4A are not selectable because only daily double wagers can include entrants "7" and "8" from Race 2 and all probable payout combinations including these entrants are shown by selecting entrant numbers "1" through "6."

However, if Race 1 were to include eight entrants and Race 2 were to include only six entrants, for example, then entrants "7" and "8" would be selectable. When entrant number "7" or "8" is selected in this scenario, no daily double probable payout information would be displayed under entrants "7" and "8" because the second race does not have a seventh and an eighth entrants. The "7" and "8" options, however, are selectable because they are still pertinent to the quiniela and exacta wagers.

In an exemplary graphical user interface, the probable payout values are preferably displayed as selectable numbers, the selection of which selects a wager that is to be placed by the user. For example, selecting "$24.80" from the quiniela line of FIG. 4 selects a quiniela wager including entrants "1" and "2" from Race 1. This selection is then displayed to the user in the selection window 208 of FIG. 3, and the wager may be placed by the user by selecting the "SUBMIT" button displayed in the interface of FIG. 3.

Figure 6:
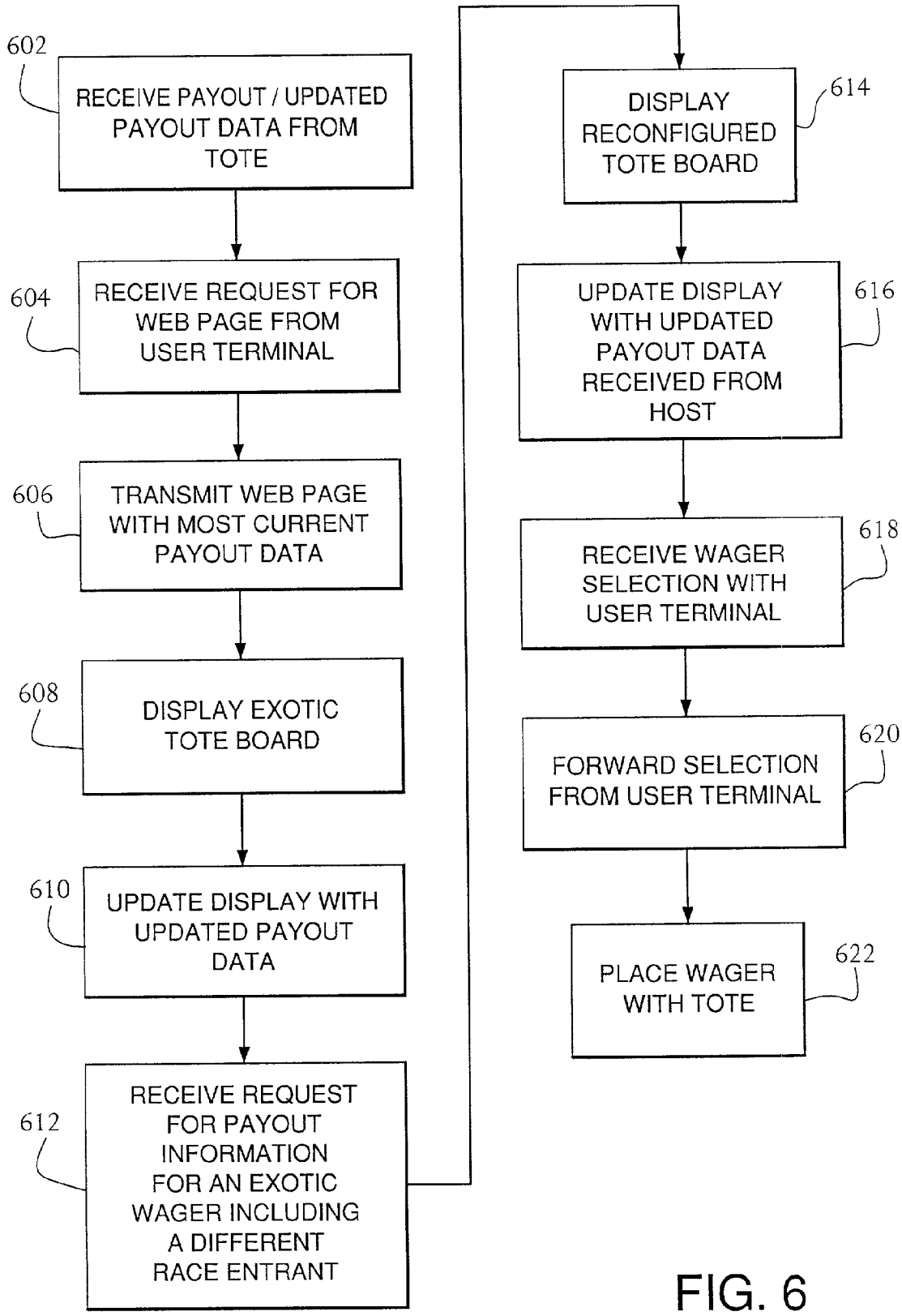
FIG. 6 is a flow diagram illustrating the display of probable payout information as shown in the graphical user interface of FIGS. 4 and 4A.

FIG. 6 is a flow diagram illustrating one exemplary method of providing probable payout information to a user in a wagering system 100. At 602, probable payout information is received from a totalisator 116 by, for example, a computer processor unit 104. Updated probable payout information is also periodically received from totalisator 116. A request for a Web page is received from a user terminal at 604, and a Web page is transmitted with the most recent probable payout data at 606. At 608, the exotic tote board as shown in the graphical user interface of FIG. 4, for example, is displayed on the display of a user terminal. At 610, the probable payout information displayed within the exotic tote board is updated periodically with updated probable payout information received by the user terminal from the computer processor unit. At 612, a request for probable payout information for an exotic wager including a different entrant is received, and a reconfigured tote board is displayed at 614 as shown, for example, in the graphical user interface of FIG. 4A. The display is periodically updated at step 616 with updated probable payout information received by the user terminal from the computer processor unit, which receives updated probable payout information form a totalisator.

Steps 612 through 614 may be repeated until the display is terminated (e.g., a page is closed) or a wager selection is received at step 618. As mentioned, the wager selection can be made by selecting one of the probable payouts listed in the table of the graphical user interface as shown in FIGS. 4 and 4A or through the graphical user interface as shown in FIGS. 3 and 3A.

The selected wager is then forwarded to the computer processor unit 104 at 620, and the wager is placed with a totalisator, such as Tote A, at 622. When a wager selection is forwarded from a computer processor unit 104 to Tote A, Tote A first confirms that the race is still open for wagering. If the race is still open for wagering, Tote A checks to see whether the wager is still a valid selection. It may be that the wager selection was transmitted from a user terminal 110, 108 to the computer processor unit 104 before the user terminal was provided information identifying, for example, that an entrant has scratched from the race, i.e., the wagerer was placed before updated information was received by the user terminal and displayed to the user. If the wager selection is still valid, the wager is placed with the totalisator managing the wager's account (i.e., Tote A) and updated pool totals are transmitted to the host tote. If the wager is being placed on a race or races at a track associated with Tote A, then Tote A is the host totalisator for the transaction. If the wager is being placed on a race or races at a track associated with a different totalisator, such as Tote B, then that totalisator is the host totalisator for the transaction and Tote A is the guest totalisator for the transaction.

After the wager is placed by or with Tote A, a transaction number is preferably returned to the computer processor unit 104 and, in turn, is provided to the terminal 108 or 110 by the computer processor unit 104. The user can then print a copy of a ticket, but not an actual, redeemable ticket, using the user terminal.

Figure 5:
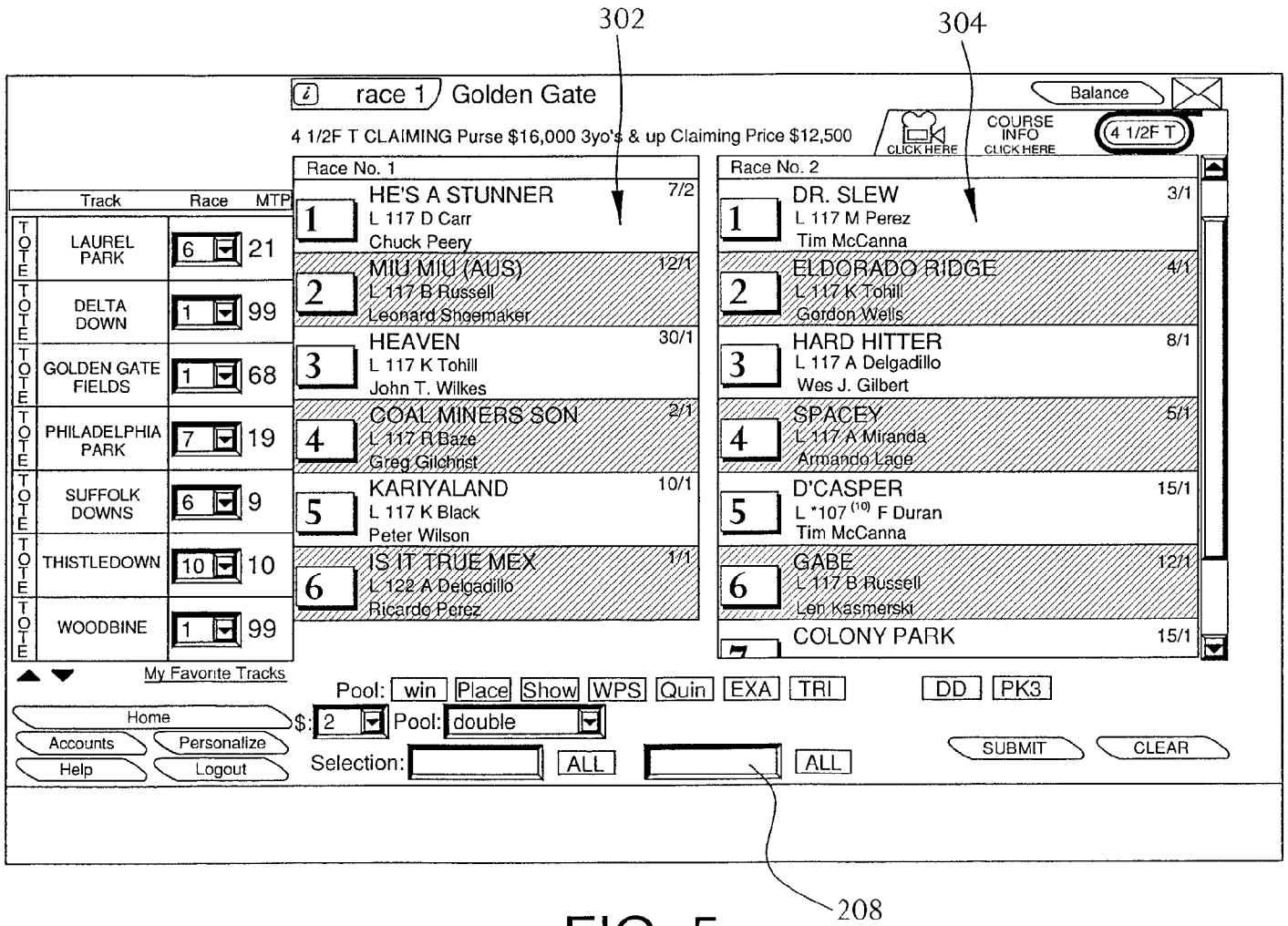
FIGS. 5 and 5A illustrate an exemplary graphical user interface for providing program information for a plurality of races within a multiple race wager group.

FIGS. 5 and 5B illustrate an exemplary graphical user interface for providing program information to a user associated with races within a multiple race wager group, e.g., daily double wagers, pick three wagers, pick six wagers, pick nine wagers, or other wagers that require the selection of an entrant from more than one race. FIG. 3, for example, indicates with selectable buttons "DD" and "PK3" that daily double and pick three wagers are available for Race 1. As is standard in the racing industry, a daily double wager requires a selection of the winning entrant in two consecutive races (e.g., Race 1 and Race 2; Race 2 and Race 3, etc.), and a pick three wager requires a selection of the winning entrant in three consecutive races (e.g., Race 1, Race 2 and Race 3; Race 2, Race 3 and Race 4, etc.). If a user selects the "DD" button from the graphical user interface of FIG. 3, for example, the graphical user interface of FIG. 5 is displayed to the user. The graphical user interface of FIG. 5 displays at 302 program information pertinent to Race No. 1—the first leg of the daily double wager—and displays at 304 program information pertinent to Race No. 2—the second leg of the daily double wager. This information is periodically updated in the graphical user interface with updated program information (e.g., scratches, etc.) provided from the computer processor unit 104 and the totalisator 116.

The graphical user interface of FIG. 5 enhances the ease by which a user can reviewing program information relating to a wager in a multiple race wager group as well as the ease by which a user can place a wager. Program information for both races included within the daily double wager are displayed to the user simultaneously, thereby allowing the user to view this information together without having to navigate several different screens to obtain this information. In one embodiment of the graphical user interface, an identifier for each entrant, such as the entrant number, is selectable in order to allow the user to select the entrant for wagering. For example, the user can select "1" from display 302 and "2" from display 304 to select a daily double wager including these two entrants. As explained in connection with FIGS. 3 and 3A, the program information is preferably displayed along with the other wagering buttons in an exemplary wagering interface. The user's daily double wager, whether selected through the entrant numbers of displays 302 or 304 or whether manually entered into text box 208, can then be submitted by selecting the SUBMIT option.

Figure 5A:
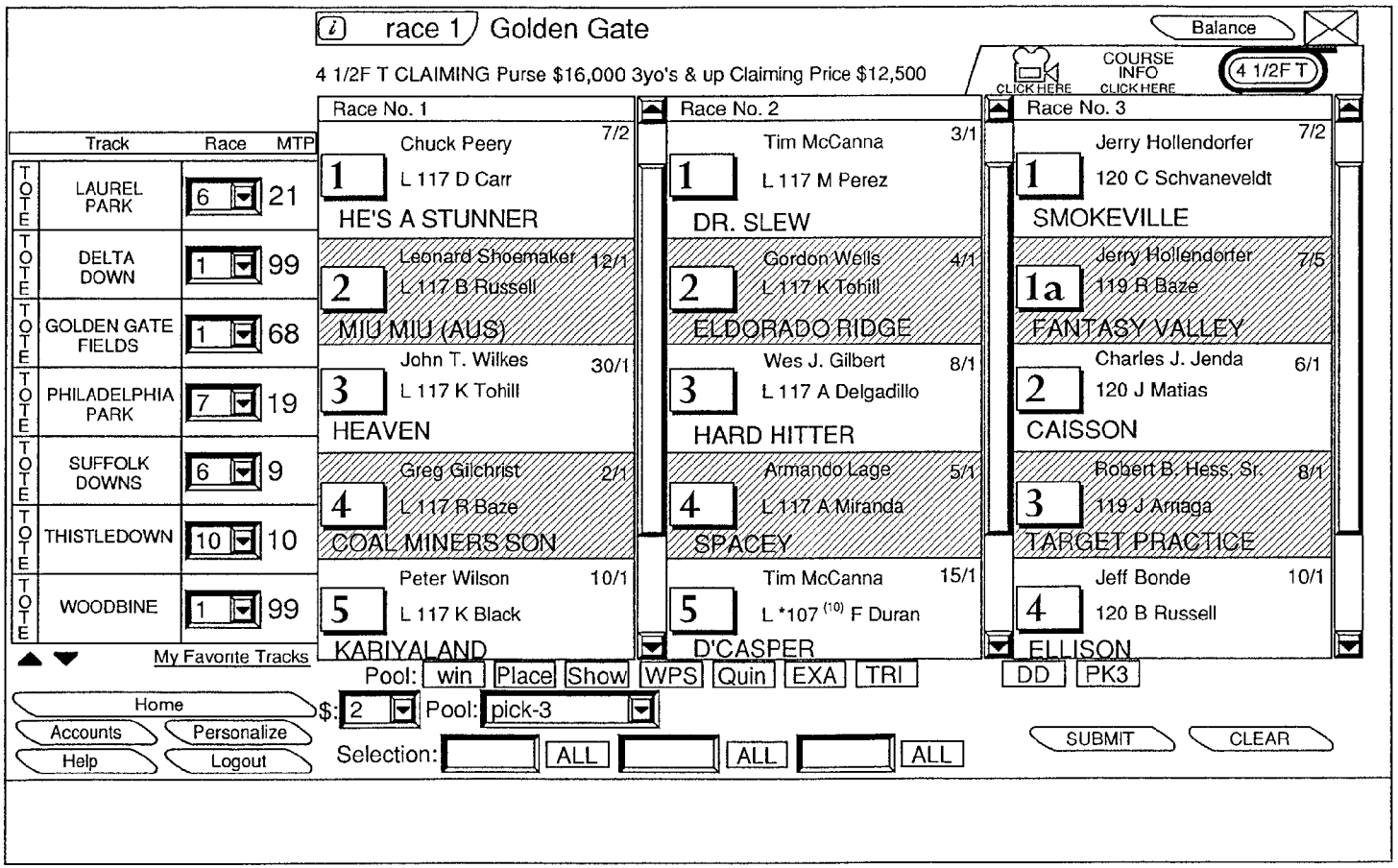

FIG. 5A is another example of an exemplary graphical user interface showing program information for a plurality of races within a multiple race wager group. The interface of FIG. 5A is displayed in response to a selection of the pick three option PK3. Program information is displayed to the user for the three legs of the pick three wager—Race No. 1, Race No. 2 and Race No. 3. Again, in one embodiment of an exemplary graphical user interface, the user can select entrant's for the pick three wager by selecting a selectable identifier for the entrant, such as the entrant's number, and the wager can be submitted using the other selectable options as described above.

Figure 7:
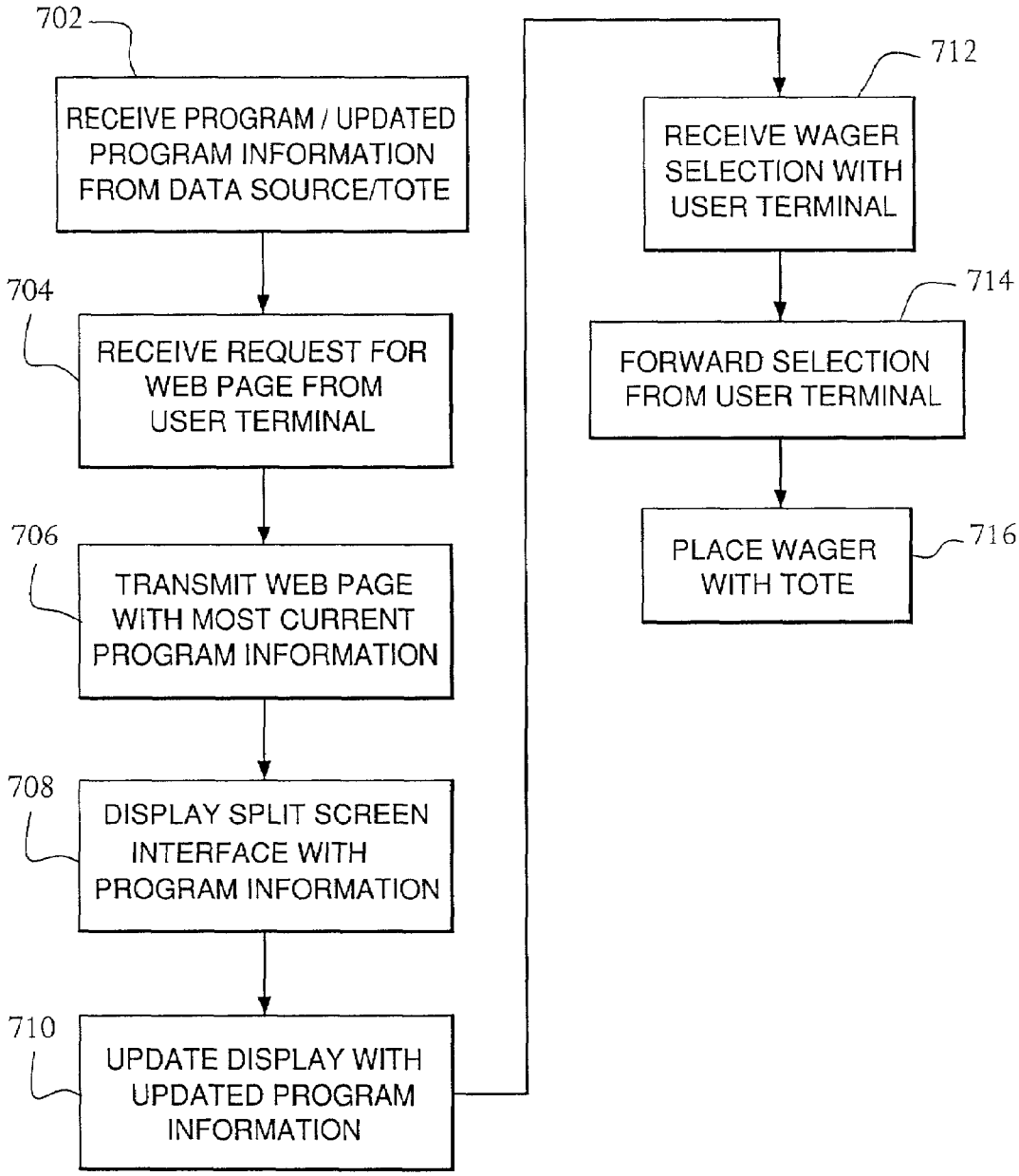
FIG. 7 is a flow diagram illustrating the display of program information as shown in the graphical user interface of FIGS. 5 and 5A.

FIG. 7 is a flow diagram illustrating an exemplary method of providing the program information to a user in a wagering system. At 702, program information is received from a data source 118 by, for example, a computer processor unit 104. Updated program information is also periodically received from a totalisator, such as Tote A. A request for a Web page is received from a user terminal at 704, and a Web page is transmitted at 706 with the most recent program information that has been received from the data source 118. At 708, a graphical user interface with program information relating to each race within a multiple race wager group, as shown in FIG. 5 or 5A, for example, is displayed on the display of a user terminal. At 710, the program information displayed within the graphical user interface is updated periodically with updated program information, such as scratch information and overweight information, received by the user terminal from the computer processor unit, which receives updated program information from a totalisator 116.

Step 710 is preferably repeated until the display is terminated (e.g., a page is closed) or a wager selection is received at step 712. The wager selection is then forwarded at step 714 and placed with a totalisator 716, as explained above in connection with steps 618 through 622 of FIG. 6.

The system and method of the present invention may be implemented by utilizing at least a part of the system 100 described above in connection with FIG. 2. It should be apparent to one of ordinary skill that the system may be incorporated in a LAN, in a WAN, or through an Internet 114 based approach, such as through a hosted or non-hosted application service, or through a combination thereof. The functionality of the method may be programmed and executed by at least one computer processor unit 104, with necessary data and graphical interface pages as described hereafter stored in and retrieved from a data storage unit 106. A user can access this functionality using a user device 110 or computer terminal 108.

It should be understood, however, that although described herein, the methods of displaying racing information to users described herein are not limited to what is conventionally considered a Web page. The methods are equally well suited for use in other network communication systems. For example, the methods are also applicable to pages received and displayed using other interactive platforms, such as interactive television systems. Still further, the methods are applicable to systems and wagering terminals for providing racing information to users utilized at off track betting (OTB) sites and at race tracks.

The method and system as described herein are also by no means limited to horse races, but rather are applicable to other kinds of races, such as dog races and harness races, and other wagering events where a plurality of entrants are wagered upon and for which program type information and probable payouts are provided to a user.

The present invention can be embodied in the form of methods and apparatus for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

Although exemplary embodiments are described in detail above, the invention is not limited thereto. Rather, the invention should be construed broadly to include other variants and embodiments, which may be practiced within the scope and range of equivalents of the appended claims.

What is claimed is:

1. A method of providing probable payout information to a user for an exotic wager type, said exotic wager type requiring either a selection of two entrants from a single race or an entrant from each of two races, comprising the steps of:

(a) displaying a table in a graphical user interface screen, said table including first probable payout information for said exotic wager type, said first probable payout information indicating: (1) a respective probable payout for a selection of a first entrant from a first race and a selection of each other entrant from said first race, and (2) a respective probable payout for a selection of said first entrant from said first race and a selection of each entrant from a second race; and (b) in response to a request by said user, displaying a reconfigured table in said graphical user interface screen, said reconfigured table including second probable payout information for said exotic wager type, said second probable payout information indicating: (1) a respective probable payout for a selection of a second entrant from said first race and a selection of each other entrant from said first race, and (2) a respective probable payout for a selection of said second entrant from said first race and a selection of each entrant from said second race, wherein said graphical user interface screen includes a first set of a plurality of selectable graphical identifiers each associated with respective entrants in said first race, whereby said request is received from said user, and wherein said graphical user interface screen includes a second set of a plurality of selectable graphical identifiers each associated with a respective combination of entrants for said exotic wager type, selection of an individual selectable graphical identifier from said second set of selectable graphical identifiers initiating placement of a wager on the respective combination of entrants associated with said selected individual selectable graphical identifier, wherein said first and second sets are displayed together in said graphical user interface screen for selection by said user.

2. The method of claim 1, wherein said table and reconfigured table include probable payout information for a quiniela wager, an exacta wager, a daily double wager, or a combination thereof.

3. The method of claim 1, further comprising the step of receiving from said user a request to display said reconfigured table.

4. The method of claim 3, wherein said receiving step includes the step of receiving a selection by said user of a selectable graphical identifier associated with said second entrant.

5. The method of claim 3, further comprising the steps of:

receiving with at least one processor said first probable payout information and said second probable payout information from a totalisator, said at least one processor being connected to a user terminal through the Internet, and providing said first probable payout information and second probable payout information to said user terminal with said at least one processor, wherein said graphical user interface screen is a Web page displayed on a display of said user terminal.

6. The method of claim 5, further comprising the step of:

periodically receiving updated probable payout information from said totalisator with said computer processor unit; and periodically updating said second probable payout information within said reconfigured table.

7. The method of claim 5 further comprising the step of transmitting a program applet to said user terminal, said program applet directing the display of said second probable payout information in said reconfigured table.

8. The method of claim 1, further comprising the step of periodically updating said second probable payout information in said graphical user interface screen.

9. The method of claim 1, wherein said step of displaying said reconfigured table includes the step of replacing said first probable payout information with said second probable payout information in said graphical user interface.

10. The method of claim 1, wherein said table and reconfigured table display probable payout information for at least two wager types selected from the group consisting of: a quiniela wager, an exacta wager and a daily double wager.

11. The method of claim 1, wherein said selectable graphical identifiers from said second set of selectable graphical identifiers are selectable probable payout monetary values displayed in said table and reconfigured table.

12. A system for providing probable payout information to a user for an exotic wager type, said exotic wager type requiring either a selection of two entrants from a single race or an entrant from each of two races, comprising:

at least one processor, said at least one processor configured to:

display a table in a graphical user interface screen displayed by a user terminal, said table including first probable payout information for said exotic wager type, said first probable payout information indicating: (1) a respective probable payout for a selection of a first entrant from a first race and a selection of each other entrant from said first race, and (2) a respective probable payout for a selection of said first entrant from said first race and a selection of each entrant from a second race; and in response to a request by said user, displaying a reconfigured table in said graphical user interface screen, said reconfigured table including second probable payout information for said exotic wager type, said second probable payout information indicating: (1) a respective probable payout for a selection of a second entrant from said first race and a selection of each other entrant from said first race, and (2) a respective probable payout for a selection of said second entrant from said first race and a selection of each entrant from said second race, wherein said graphical user interface screen includes a first set of a plurality of selectable graphical identifiers each associated with respective entrants in said first race, whereby said request is received from said user, and wherein said graphical user interface screen includes a second set of a plurality of selectable graphical identifiers each associated with a respective combination of entrants for said exotic wager type, selection of an individual selectable graphical identifier from said second set of selectable graphical identifiers initiating placement of a wager on the respective combination of entrants associated with said selected individual selectable graphical identifier, wherein said first and second sets are displayed together in said graphical user interface for selection by said user screen.

13. The system of claim 12, wherein said table and reconfigured table include probable payout information for a quiniela wager, an exacta wager, a daily double wager, or a combination thereof.

14. The system of claim 12, further comprising a user terminal for receiving from said user a request to display said reconfigured table.

15. The system of claim 14, wherein said user terminal receives a selection by said user of a selectable graphical identifier associated with said second entrant.

16. The system of claim 12, further comprising a totalisator, said totalisator providing said at least one processor with said first and second probable payout information and periodically providing said processor with updated probable payout information.

17. The system of claim 16, wherein said at least one processor is connected to said user terminal through the Internet, and wherein said graphical user interface is a Web page displayed on a display of said user terminal.

18. The system of claim 17, wherein said at least one processor is configured to periodically provide said user terminal with said updated probable payout information, and wherein said second probable payout information is periodically updated on said display.

19. The system of claim 17, wherein said at least one processor is further configured to transmit a program applet to said user terminal, said program applet directing the display of said second probable payout information in said reconfigured table.

20. The system of claim 12, wherein said at least one processor is configured to periodically provide updated probable payout information to said user terminal for updating said second probable payout information in said graphical user interface screen.

21. The system of claim 12, wherein said table and reconfigured table display probable payout information for at least two wager types selected from the group consisting of: a quiniela wager, an exacta wager and a daily double wager.

22. The system of claims 12, wherein said selectable graphical identifiers from said second set of selectable graphical identifiers are selectable probable payout monetary values displayed in said table and reconfigured table.

23. A method of providing probable payout information to a user for a plurality of exotic wager types, said exotic wager types requiring either a selection of two entrants from a single race or an entrant from each of two races, comprising the steps of:

(a) displaying a table in a graphical user interface screen, said table including first probable payout information for at least first and second exotic wager types, said first probable payout information indicating respective probable payouts for said at least first and second exotic wager types for a selection of a first entrant from a first race and a selection of one or more other entrants from said first race and one or more entrants from a second race; and (b) in response to a single request by said user, displaying a reconfigured table in said graphical user interface screen, said reconfigured table including second probable payout information for said first and second exotic wager types, said second probable payout information indicating respective probable payouts for said at least first and second exotic wager types for a selection of a second entrant from said first race and a selection of one or more other entrants from said first race and a selection of one or more entrants from said second race, wherein said first and second entrants are selectable by said user from any entrants in said first race, wherein said graphical user interface screen includes a first set of a plurality of selectable graphical identifiers each associated with respective entrants in said first race, whereby said request is received from said user, and wherein said graphical user interface screen includes a second set of a plurality of selectable graphical identifiers each associated with a respective combination of entrants for said exotic wager type, selection of an individual selectable graphical identifier from said second set of selectable graphical identifiers initiating placement of a wager on the respective combination of entrants associated with said selected individual selectable graphical identifier, wherein said first and second sets are displayed together in said graphical user interface screen for selection by said user.

24. The method of claim 23, wherein said exotic wager types are selected from the group consisting of: quiniela wager, an exacta wager and a daily double wager.

25. The method of claim 23, herein said first and second probable payout information comprise payout information for at least three exotic wager types.

26. The method of claim 25, wherein said at least three exotic wager types comprise a quiniela wager, an exacta wager and a daily double wager.

27. The method of claim 23, further comprising the steps of:

providing said first probable payout information and second probable payout information to said user terminal through the Internet; and transmitting a program applet to said user terminal, said program applet directing the display of said second probable payout information in said reconfigured table, wherein said graphical user interface screen is a Web page.

28. A system for providing probable payout information to a user for a plurality of exotic wager types, said exotic wager types requiring either a selection of two entrants from a single race or an entrant from each of two races, comprising:

at least one processor, said at least one processor configured to:

(a) display a table in a graphical user interface screen, said table including first probable payout information for at least first and second exotic wager types, said first probable payout information indicating respective probable payouts for said at least first and second exotic wager types for a selection of a first entrant from a first race and a selection of one or more other entrants from said first race and one or more entrants from a second race; and (b) in response to a single request by said user, display a reconfigured table in said graphical user interface screen, said reconfigured table including second probable payout information for said first and second exotic wager types, said second probable payout information indicating respective probable payouts for said at least first and second exotic wager types for a selection of a second entrant from said first race and a selection of one or more other entrants from said first race and a selection of one or more entrants from said second race, wherein said first and second entrants are selectable by said user from any entrants in said first race, wherein said graphical user interface screen includes a first set of a plurality of selectable graphical identifiers each associated with respective entrants in said first race, whereby said request is received from said user, and wherein said graphical user interface screen includes a second set of a plurality of selectable graphical identifiers each associated with a respective combination of entrants for said exotic wager type, selection of an individual selectable graphical identifier from said second set of selectable graphical identifiers initiating placement of a wager on the respective combination of entrants associated with said selected individual selectable graphical identifier, wherein said first and second sets are displayed together in said graphical user interface for selection by said user screen.

29. The system of claim 28, wherein said exotic wager types are selected from the group consisting of: a quiniela wager, an exacta wager and a daily double wager.

30. The system of claim 28, wherein said first and second probable payout information comprise payout information for at least three exotic wager types.

31. The system claim 30, wherein said at least three exotic wager types comprise a quiniela wager, an exacta wager and a daily double wager.

32. The system of claim 28, wherein said at least one processor is further configured to:

provide said first probable payout information and second probable payout information to said user terminal through the Internet; and transmit a program applet to said user terminal, said program applet directing the display of said second probable payout information in said reconfigured table, wherein said graphical user interface screen is a Web page.

* * * * *